United States Patent [19]

Hay et al.

[11] Patent Number: 4,875,420

[45] Date of Patent: Oct. 24, 1989

[54] MOBILE HAZARDOUS WASTE TREATMENT SYSTEM

[75] Inventors: George H. Hay, Dallas; Jeffrey P. Bleke, Arlington, both of Tex.

[73] Assignee: Infrared Waste Technology, Inc., San Francisco, Calif.

[21] Appl. No.: 222,323

[22] Filed: Jul. 20, 1988

Related U.S. Application Data

[63] Continuation of Ser. No. 93,295, Sep. 4, 1987, abandoned.

[51] Int. Cl.[4] ..... F23G 7/00

[52] U.S. Cl. ..... 110/215; 110/233; 110/234; 110/240; 110/257

[58] Field of Search ..... 110/203, 208, 210, 211, 110/214, 215, 216, 233, 235, 240, 241, 255, 257, 237, 236

[56] References Cited

U.S. PATENT DOCUMENTS

| | | | |
|---|---|---|---|
| 3,233,565 | 2/1966 | Sharpe | 110/235 |
| 3,307,507 | 3/1967 | Boyd et al. | 110/240 X |
| 3,626,874 | 12/1971 | Grant | 110/233 X |
| 3,741,133 | 6/1973 | Kleinfelter | 110/215 X |
| 3,785,302 | 1/1974 | Davis | 110/215 |
| 3,859,934 | 1/1975 | Wehalt | 110/240 X |
| 3,899,984 | 8/1975 | Keyes et al. | 110/240 X |
| 3,911,836 | 10/1975 | Brown | 110/257 X |
| 4,359,951 | 11/1982 | Dauvergne | 110/234 |

*Primary Examiner*—Henry C. Yuen

*Attorney, Agent, or Firm*—Johnson & Gibbs

[57] ABSTRACT

A mobile hazardous waste treatment facility (10) is provided for transfer to a remote treatment site where it can be rapidly assembled and disassembled. A primary combustion chamber (20) is placed on a trailer and support section (74). A secondary combustion chamber (24) and a scrubber section (37) are also placed on trailers (119, 127 and 196). Each trailer (74, 119, 127 and 196) is provided with three sets of hydraulic jacks for leveling and lowering the appropriate piece of equipment to jack stands on a concrete slab.

14 Claims, 4 Drawing Sheets

MOBILE HAZARDOUS WASTE TREATMENT SYSTEM

RELATED APPLICATION

This is a continuation application of application Ser. No. 071,093,295 filed Sept. 4, 1987 and entitled "Mobile Hazardous Waste Treatment System" now abandoned.

TECHNICAL FIELD OF THE INVENTION

This invention relates in general to hazardous waste treatment systems, and in particular to a mobile hazardous waste treatment system.

BACKGROUND OF THE INVENTION

Hazardous waste treatment has typically been accomplished by implant systems, which are permanently built at a treatment site. Such inplant systems have normally been built at sites which generate waste on a day-to-day basis, such that it is more cost effective to build a permanent treatment site at the facility than to have the waste hauled away. However, if a permanent site is creating waste material on an infrequent basis or if an abandoned production location contains waste materials, it has not been cost effective to build a permanent site which would only operate sporadically or for a short period of time. Further, due to more stringent environmental laws, including those that affect the transportability of hazardous waste material, it is becoming increasingly difficult to dispose of waste material.

To meet this demand, component systems have heretofore been designed to be transported to various sites, and then assembled. Unfortunately, such systems may take one to two months to install once they have arrived at the site.

A need has thus arisen for a mobile hazardous waste treatment facility that may be rapidly assembled and disassembled at a remote treatment site.

SUMMARY OF THE INVENTION

The present invention disclosed and claimed herein describes a mobile hazardous waste treatment facility which substantially eliminates problems associated with prior transportable treatment facilities.

It is a primary advantage of the present invention that a unit with a large capacity is placed in a mobile condition for rapid transport to various sites with rapid set up and disassembly. In one test of the system disassembly was done within 23 hours.

In the preferred embodiment of the invention, a mobile hazardous waste treatment system comprises a primary combustion chamber, a secondary combustion chamber, and a scrubber section. The primary combustion chamber is connected to the secondary combustion chamber by a crossover duct. The scrubber section is connected to the secondary combustion chamber distal the crossover duct.

The primary combustion chamber receives and burns or oxidizes the hazardous waste material. As a result of this burning, the hazardous waste material is converted into ash and waste gas. The ash is removed from the primary combustion chamber for disposal, while the waste gas is transferred to the secondary combustion chamber for further processing.

The secondary combustion chamber receives the waste gas from the primary combustion chamber and further burns it. The waste gas is then passed to a scrubber section which finally cleans the gas and discharges the now clean material through an exhaust stack into the atmosphere.

In accordance with the preferred embodiment, the primary combustion chamber, the secondary combustion chamber and the scrubber section are all placed on trailers. The trailers are constructed of steel I-beams. The trailers have integral goosenecks for attachment to a towing vehicle and permanently attached wheel sections.

The primary combustion chamber trailer has a wheel section comprising four sets of dual wheels, in contrast to the other trailer wheel sections which have only two sets of dual wheels. The two extra sets of wheels are required due to the weight of the primary combustion chamber. The fourth set of wheels is adjustable to meet various state laws concerning weight distribution.

The secondary combustion chamber according to the preferred embodiment is a double trailer arrangement. In operation, the two trailers are backed up to each other and then connected together. The connections are made by bolts which are inserted through holes in flanges attached to each trailer section. Before the bolts are inserted and tightened down, the flanges are coated with RTV and silicon grease to ensure an air tight seal. Each trailer has three sets of hydraulic jacks controlled from a central control station on the trailer. The hydraulic jacks are used to raise and level the trailers for operation.

BRIEF DESCRIPTION OF THE DRAWINGS

For a more complete understanding of the present invention and for further advantages thereof, reference is now made to the following Detailed Description taken in conjunction with the accompanying Drawings in which.

DETAILED DESCRIPTION OF THE INVENTION

Figure 1:
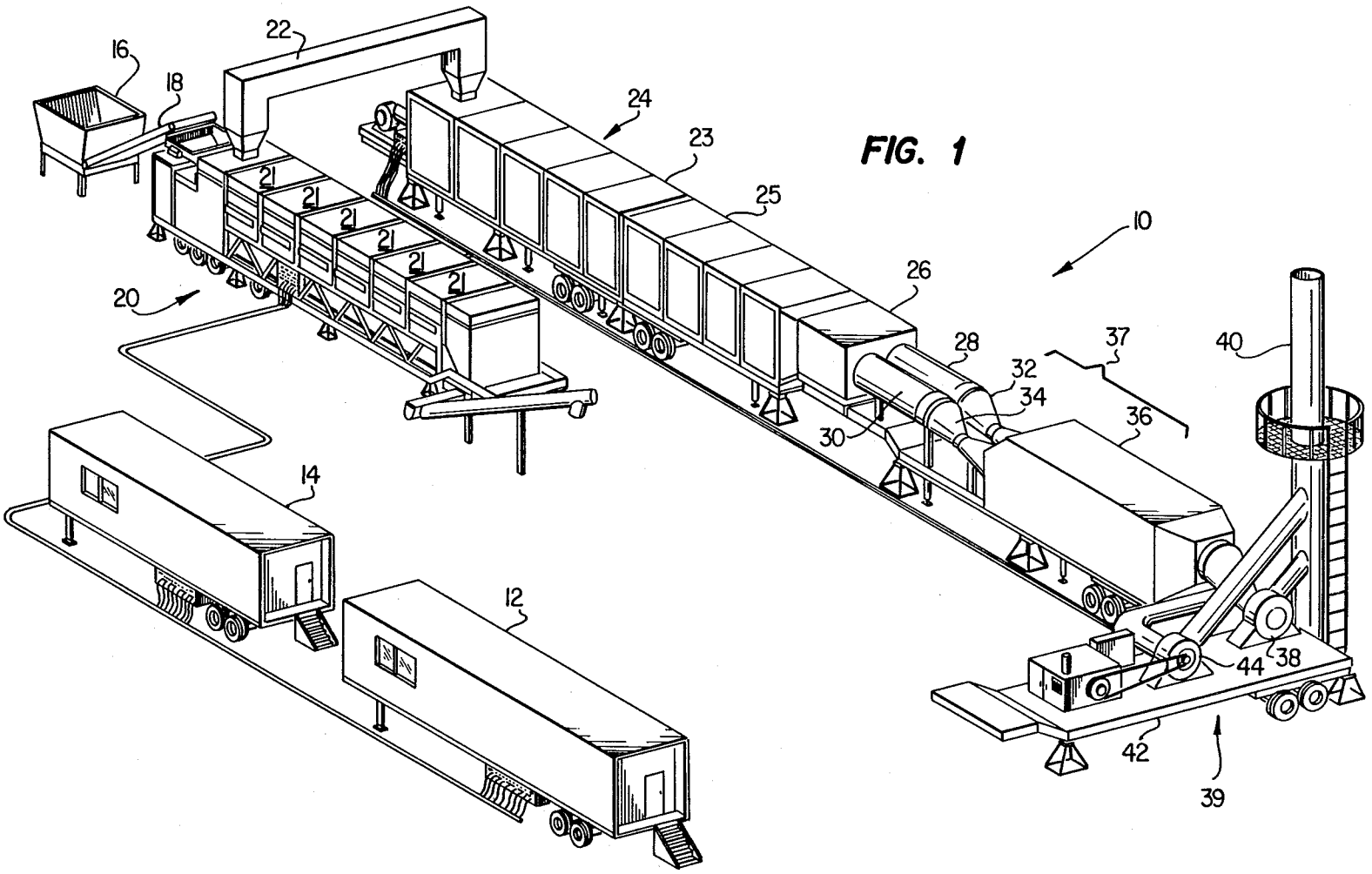
FIG. 1 is a side perspective view of the present invention.

Referring to FIG. 1, a mobile hazardous waste treatment facility in accordance with the present invention is generally identified by the reference numeral 10. The mobile facility 10 includes a power van 12 for carrying transformers (not shown) that power the mobile system 10. A control van 14 is provided for carrying the instruments, controls and switches (not shown) necessary to operate the mobile system 10.

A feed hopper 16 receives the waste material desired to be processed and supplies the waste to a feed conveyor 18. The feed conveyor 18 may be opened or closed to the atmosphere as necessary depending upon the nature of the hazardous waste material being disposed of. The feed conveyor 18 deposits the hazardous waste material into a primary combustion chamber 20. The primary combustion chamber 20 may comprise separable combustion units 21.

As the primary combustion chamber 20 burns or incinerates the waste material, waste gases are formed. These waste gases are removed from the primary combustion chamber 20 through a crossover duct 22. At its opposite end, the crossover duct 22 deposits the waste gases into a secondary combustion chamber 24.

The secondary combustion chamber comprises a first section 23 and a second section 25. The secondary combustion chamber 24 further burns the waste gases which then enter a transition duct 26. The waste gases then pass through a pair of quench tubes, 28 and 30, which lead to a pair of venturi tubes 32 and 34.

From the venturi tubes 32 and 34, the waste gases enter an absorber 36 where the final cleaning of the gases is performed. The venturi tubes 32 and 34 and the absorber portion 36 form a scrubber section 37. The now clean exhaust is passed through an induced draft fan 38 and out an exhaust stack 40.

The induced draft fan 38 provides a draft in a counterflow direction along the length of the primary combustion chamber 20. This induced draft prevents leakage of waste gases. The induced draft fan 38 also pulls the waste gases from the primary combustion chamber 20 through the crossover duct 22 into the secondary combustion chamber 24. From the secondary combustion chamber 24, the induced draft fan pulls the waste gases through the transition duct 26, through the scrubber section 37 and out the exhaust stack 40.

The exhaust stack 40 and the induced draft fan 38 form an emergency backup section 39 and are carried by an emergency backup trailer 42. Also carried by the emergency backup trailer 42 is a backup induced draft fan 44.

Figure 2:
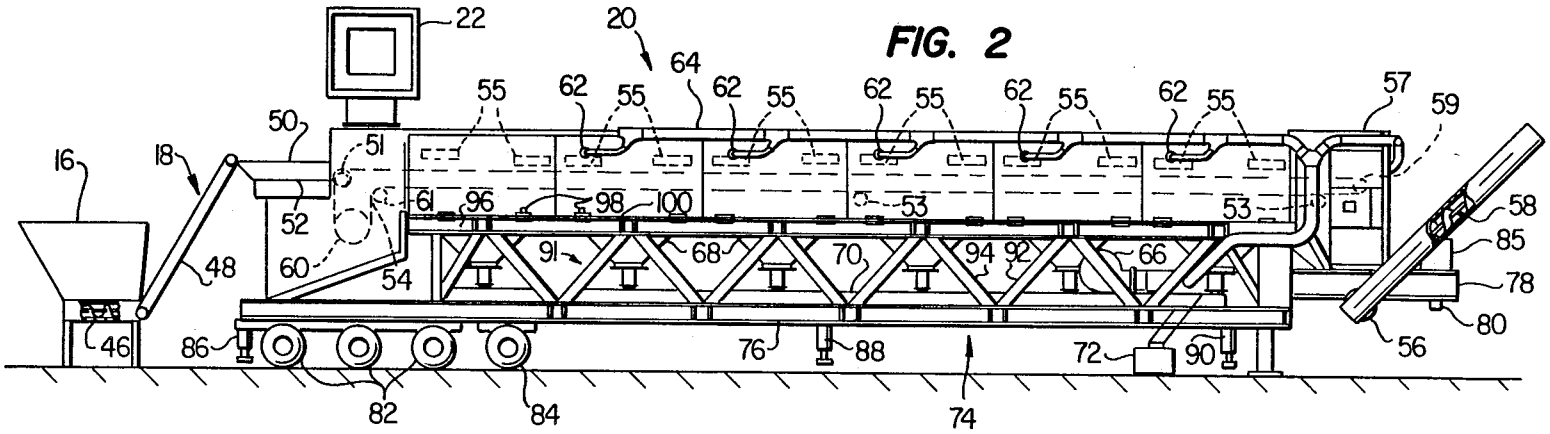
FIG. 2 is a side view of the primary combustion chamber section.

Referring to FIG. 2, the hopper 16 can be seen to include an auger 46 in its bottom. The waste material is deposited in the hopper 16, and is then fed by the auger 46 to the conveyor 18. The hopper 16 and the conveyor 18 can be open or closed to the atmosphere depending upon the nature of the waste material. The conveyor 18 has a conveyor belt 48 for transporting the waste material from the auger 46 to the primary combustion chamber 20. The conveyor belt 48 may alternatively be an auger or screw (not shown). At the input end 50 of the primary combustion chamber 20, there is an airlock 52. The airlock 52 is of a type well known in the art and is utilized to prevent the escape of combustion gases and/or leakage of air from the primary combustion chamber 20. The waste material passes through the airlock 52 and is deposited on a wire mesh belt 54. The wire mesh belt 54 is driven by a motor (not shown) and supported by a plurality of rollers such as rollers 51, 53, 59 and 61 spaced appropriately along the path of the wire mesh belt 54. The wire mesh belt 54 carries the waste material through the primary combustion chamber 20 which burns the waste material at a temperature of approximately 1800° F. The incineration of the waste material is done by an apparatus similar to the system described in U.S. Pat. No. 4,050,900, Sept. 27, 1977, to Hobbs, et al., assigned to Shirco, Inc., and a process such as described in U.S. Pat. No. 4,202,282, May 13, 1980, to Hobbs, et al., assigned to Shirco, Inc., both of which are incorporated herein by reference.

The waste material is progressively burned or oxidized by infrared heat units 55 into gas and ash as it proceeds along the wire mesh belt 54. By the time the waste material has reached the end 57 opposite the airlock 52 of the primary combustion chamber 20, the material is roasted ash. The roasted ash is dropped into a discharge tube 56 which is then removed by an ash clean out discharge screw 58. The ash is deposited from the ash clean out discharge screw 58 into a removable container (not shown).

At the end of the primary combustion chamber 20 proximate the airlock 52, the wire mesh belt 54 becomes a catenary loop 60. The catenary loop 60 is designed to compensate for expansion and contraction of the wire mesh belt 54 during the heating and cooling of the system. This is accomplished by passing the wire mesh belt 54 over rollers 51 and 61 which act as fixed points for the wire mesh belt 54 to hang from and thus form the catenary loop 60. Thus, as the wire mesh belt 54 expands or contracts, it will hang lower or higher from the rollers 51 and 61.

The primary combustion chamber 20 has air infeed ducts 62 for the combustion units 21. Each infeed duct 62 is individually adjustable by a valve (not shown). The air ducts 62 are utilized to supply the oxygen necessary for complete combustion of the waste material. The ducts 2 are interconnected through pipe 64 which is in turn attached to a blower fan 66. Blower fan 66 provides air through the tube 64 to each individual air duct 62 which then allows the correct amount of air to enter the combustion units 21 as determined by their individually adjusted valves.

Although the majority of the roasted ash is removed by the ash clean out discharge screw 58, some of the ash will tend to remain on the belt 54. As the belt 54 returns to the air lock, the remaining ash will fall from the belt. As the ash falls, it is deposited in hoppers 68. The ash is removed from the hoppers 68 by a removal screw 70 and deposited into a waste container 72. The waste container 72 is separate from the removable container (not shown) used with the ash clean out discharge screw 58. Due to the comparatively small amount of ash removed by the removal screw 70, a small container such as a 55 gallon drum may be used.

During the combustion process throughout the primary combustion chamber 20, waste gas is created. As stated above, this waste gas is removed from the primary combustion chamber 20 through the crossover duct 22 due to the induced counterflow draft.

The primary combustion chamber 20 is transported by a trailer and support section generally identified by the reference numeral 74. The trailer and support section 74 has two parallel I-beams forming a skid section 76 (one side shown only) that run the length of the trailer and support section 74. Integral with the skid 76 is a gooseneck 78 which may preferably be welded to the skid 76. However, if desired, the gooseneck 78 may be bolted to the skid 76 as a separate component. The gooseneck 78 has a king pin 80 for attachment to a tractor (not shown).

Fixedly attached to the skid 76 at the end distal from the goosneck 78 are three sets of dual wheels 82. The dual wheels 82 are of standard design as well known in the art. A fourth set of dual wheels 84 is slidably adjustable on the skid 76 in order to modify the trailer and support sections 74 to comply with various state laws.

Hingedly attached to the skid 76 are three sets of hydraulic jacks 86, 88 and 90 (one side shown only). A control panel 85 is positioned on the gooseneck 78. The control panel 85 is interconnected to the sets of hydraulic jacks 86, 88 and 90 by hydraulic lines (not shown). The control panel 85 is used to individually raise and lower each jack of the sets of hydraulic jacks 86, 88 and 90. The control panel 85, therefore, allows one operator to control all the sets of jacks 86, 88 and 90 from one central location.

The primary combustion chamber 20 rests on the trailer and support section 74. In order to support the primary combustion chamber 20, a support structure generally identified by the reference numeral 91 is provided. The support structure 91 is constructed of a plurality of sets of I-beams 92 and 94. The number of sets of I-beams 92 and 94 depends upon the length of the primary combustion chamber 20. The I-beams 92 and 94 are attached to the skid 76 by any appropriate method such as welding or by bolts. The I-beams 92 and 94 are connected to a pair of upper I-beams 96 adjustably attached to the bottom of the primary combustion chamber 20. The I-beams 92 and 94 are attached to the upper I-beams 96 by any appropriate method, for example, welding or bolts.

The primary combustion chamber 20 is attached to the upper I-beams 96 by bolts 98. A flange 100, which is integral with the separable combustion units 21 of the primary combustion chamber 20, matches with the upper I-beams 96. The slots 102 (See FIG. 5) are cut into the flange 100 and the upper I-beams 96. The slots 102 are oval in shape and longer in the axial direction of the upper I-beams 96 and wider in the cross-axial direction of the upper I-beams 96 than is required to fit the bolts 98. This extra axial and cross-axial space is provided to allow for expansion and contraction of the primary combustion chamber 20 during the heating and cooling of the system. Once the primary combustion chamber 20 is in place and attached to the secondary combustion chamber 24 by the crossover duct 22, the bolts 98 are loosened. Thus, when the primary combustion chamber 20 is heated to its internal operating temperature of approximately 1800° F, the expansion that occurs will be compensated for by the slots 102.

Figures 3, 10:
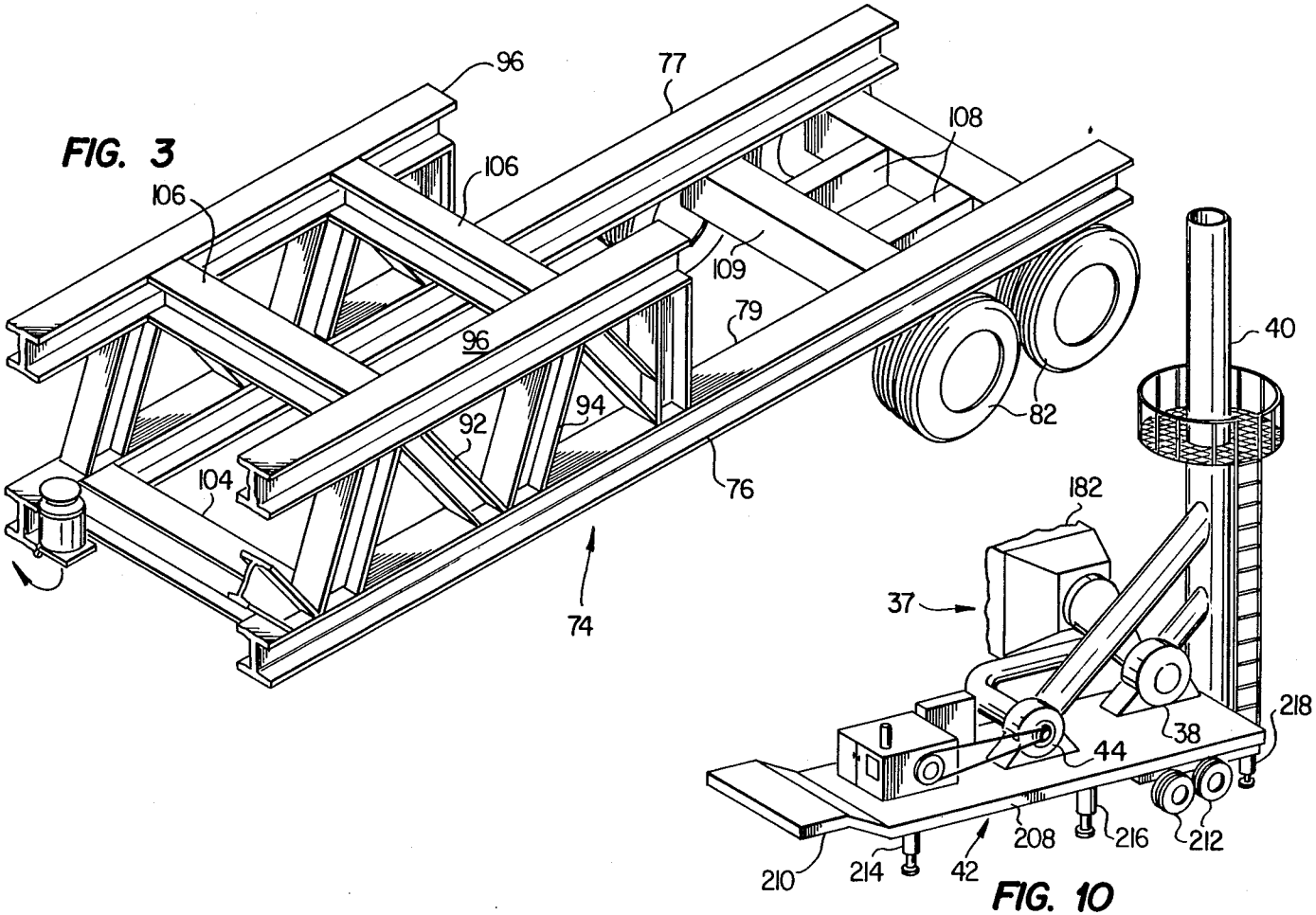
FIG. 3 is a side perspective view of the trailer and support section of FIG. 2.
FIG. 10 is a side perspective view of the backup trailer.

FIG. 3 shows in more detail the trailer and support section 74 of FIG. 2. The skid 76 comprises identical parallel I-beams 77 and 79. A plurality of cross beams 104 interconnect the I-beams 77 and 79. The sets of I-beams 92 and 94 are attached to the I-beams 77 and 79 of the skid 76 as well as to the upper I-beams 96. The upper I-beams 96 also have cross beams 106. Cross beams 104 and 106 are provided for lateral support of the trailer and support section 74.

Only one pair of dual wheels 82 is shown attached to the skid 76, for the sake of clarity, by any appropriate method such as, for example, support strap 108. Each set of dual wheels is, of course, provided with an axle 109.

Figure 4:
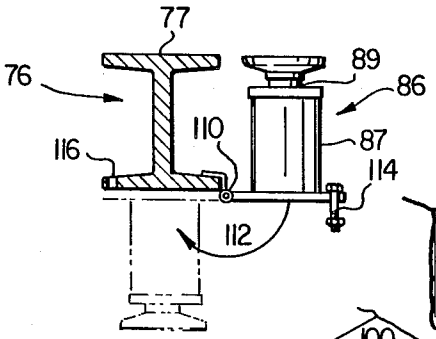
FIG. 4 is a cross-sectional view of one of the hydraulic jacks.

FIG. 4 is a detailed view of a hydraulic jack 86 which includes a cylinder 87 and a piston 89. Hydraulic fluid is provided to the cylinder 87 by a hydraulic line (not shown). Shown in solid lines, the jack 86 is stored in its upper travel position. The hydraulic jack 86 is attached to the I-beam 77 of the skid 76 by a hinge 110. The hinge 110 is fixably attached to the I-beam 77 by any appropriate method such as welding or bolts. When the primary combustion chamber 20 is in place for assembly, the hydraulic jack 86 is removed from its storage position and swung down in the direction of the arrow 112 to the operating position as shown by dotted lines. A bolt 114 is then inserted in a hole 116 in the I-beam 77 which secures the jack 86 in its operating position.

Figure 5:
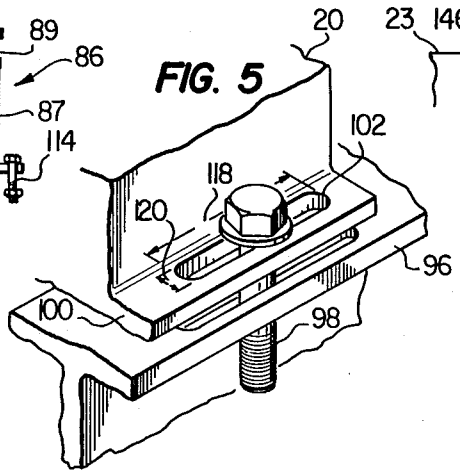
FIG. 5 is an exploded view of the expansion slots of the primary combustion chamber.

FIG. 5 shows a detailed view of one of the slots 102 and one of the bolts 98. As stated above, the slot 102, which is a matching hole in the flange 100 of the combustion chamber 20 and the upper I-beam 96, the slot 102 has a length 118 in the axial direction of the I-beam 96. The length 118 is calculated based on the operating temperature of the primary combustion chamber 20 and a known expansion factor of the materials from which the primary combustion chamber 20 is constructed. The slot 102 is also shown to have a width 120 in the cross-axial direction. The width 120 is greater than the diameter of the bolt 98. The width 120 is also calculated based on the same factors as the length 118. The bolt 98 is secured within the slot 102 by washers and a nut (not shown).

The trailers for the first section 23 and the second section 25 of the secondary combustion chamber 24, the scrubber section 37 and the emergency backup section 39 are all of standard flat bed I-beam construction similar to the skid 76 and gooseneck 78 of the primary combustion chamber 20. Due to the lower weight of these units as compared to the primary combustion chamber 20, there is no need to provide a third and fourth set of dual wheels. These trailers have the same hydraulic jack arrangement as the primary combustion chamber 20.

Figure 6:
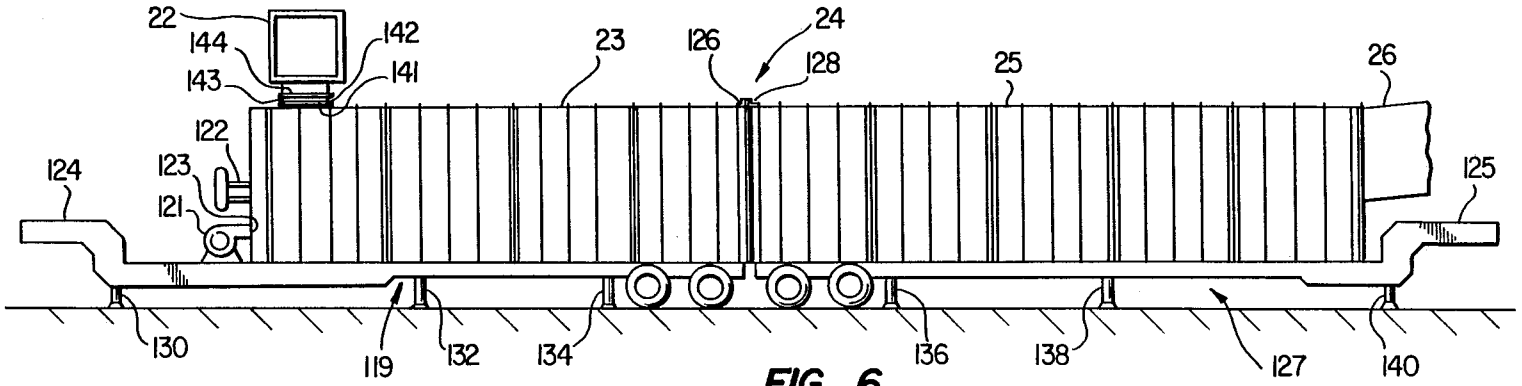
FIG. 6 is a side view of the secondary combustion chamber.

In the preferred embodiment of the present invention, the secondary combustion chamber 24 comprises a double trailer arrangement. FIG. 6 is a side view of the secondary combustion chamber 24. Secondary combustion chamber 24 has a first section 23 and a second section 25.

The waste gases from the primary combustion chamber 20 are passed through the crossover duct 22 into the first section 23 of the secondary combustion chamber 24. Four secondary heaters 122 are positioned on the gooseneck 124 of the trailer 119 of the first section 23. The secondary heaters 122 may be, for example, natural gas or propane burners. The secondary heaters 122 are supplied with fuel and controlled by devices (not shown) that are well known in the art. The secondary heaters 122 raise the temperature within the secondary combustion chamber 24 to its operating temperature of approximately 2200° F. It is necessary to raise the temperature to approximately 2200° F to completely burn the hazardous constituents in the waste gases.

The gooseneck 124 also has an air blower 121 and air ducts 123. The air ducts 123 have air jets (not shown) which penetrate the secondary combustion chamber 24. The airblower 121 provides air through the air ducts 123 to the secondary combustion chamber 24. This air is provided to assist the combustion of the waste gases and to induce a swirl to thoroughly mix and circulate the gases within the secondary combustion chamber 24.

As the gases are burned in the secondary combustion chamber 24, they move through the first section 23 to the second section 25 and into the transition duct 26. The transition duct 26 is supported during travel by a device (not shown) on the gooseneck 125 of the trailer 127 of the second section 25.

At a remote site, first section 23 and second section 25 are backed together and fixedly attached. The attachment of trailer sections 23 and 25 is by matching a flange 126 on first section 23 to a flange 128 on second section 25. The first and second sections 23 and 25 are emplaced in the same manner as is the primary combustion chamber 20, as will be discussed in more detail below, by the use of three sets of hydraulic jacks 130, 132 and 134 on the first section 23 and by hydraulic jacks 136, 138 and 140 on the second section 25. The crossover duct 22 is attached to the first section 23 of the secondary combustion chamber 24 by a double flange arrangement 141, 142, 143 and 144 as will be described in more detail below.

Figure 7:
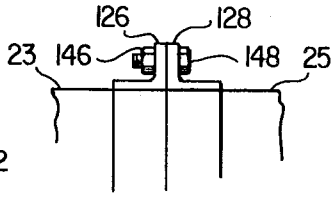
FIG. 7 is a cross-sectional view of the flange connection for the secondary combustion chamber sections.

FIG. 7 shows in more detail the arrangement of the flanges 126 and 128 of FIG. 6. As shown in cross section, the flanges 126 and 128 are seen to be L-shaped and may be, for example, angle iron. The flanges 126 and 128 are fixedly attached to the first section 23 and the second section 25 by any appropriate means such as welding or bolts (not shown). It is to be understood that the flanges 126 and 128 run the entire perimeter of the matching ends of both first and second sections 23 and 25. A plurality of bolts 148 are positioned along the flange 126 and 128. The bolts 148 are passed through matching holes (not shown) in flanges 126 and 128 and tightened with nuts 146. In order to insure an air tight seal, the flanges are coated with RTV and silicone grease by any appropriate means such as a caulking gun.

Figure 8:
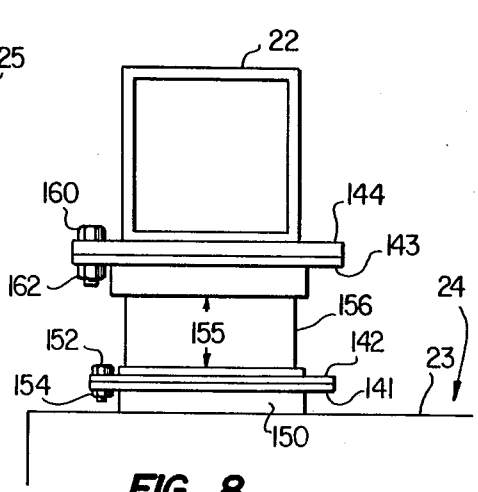
FIG. 8 is a cross-sectional view of the flange connection for the crossover shaft.

FIG. 8 depicts a detailed view of the crossover duct 22 at its attachment to the first section

23 of the secondary combustion chamber 24. A base section 150 is fixedly attached to the first section 23. The base section 150 has integral with it the first flange portion 141. Adjacent the portion 150 is a second flange portion 142 The flanges 141 and 142 are mated together and fixedly attached by using a plurality of bolts 152 and nuts 154. A middle expansion portion 156 which is fixedly attached to the second flange portion 142 and a third flange portion 143 is provided to allow compensation for positioning of the primary combustion chamber 20 in relation to the secondary combustion chamber 24. This is accomplished by providing alternate expansion portions similar to the expansion portion 156 but having a height different than height 155 of the expansion portion 156.

The third flange portion 143 mates with the fourth flange portion 144. The fourth flange portion 144 is integral with the crossover duct 22. A plurality of bolts 160 and nuts 162 are used to secure the flange 144 to the flange 143. In order to provide a complete air tight seal, RTV and silicone grease is applied between the flanges 141–142 and 143–144 by a caulking gun. Although not shown, it is to be understood that the crossover duct 22 is attached to the primary combustion chamber 20 by a similar arrangement as depicted herein by FIG. 8.

Figure 9:
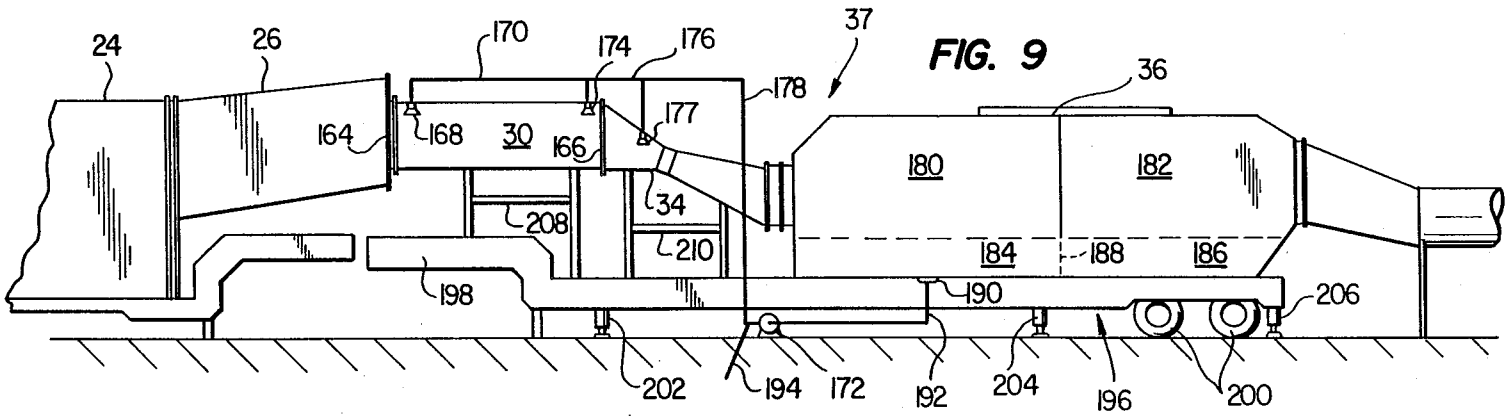
FIG. 9 is a cross-sectional view of the scrubber section.

After passing through the secondary combustion chamber 24 and the transition duct 26, the waste gases enter the scrubber section 37 (FIG. 9). The gases first enter the quench tube 30 (identical quench tube 28 is shown on FIG. 1 only). The quench tube 30 is made from special corrosive resistant stainless steel such as Inconel. The quench tube 30 has an entrance end 164 and an exit end 166. The entrance end 164 is attached to the transition duct 26 of the secondary combustion chamber by sealing devices (not shown).

The entrance end 164 of the quench tube 30 is provided with a water shower device 168. The water shower device 168 is provided with water by a water line 170 and a water pump 172. The water pump 172 and a water supply (not shown) is provided by a source external to the scrubber section 37. The exit end 166 is likewise provided with a shower device 174 which is fed by a water line 176 from the pump 172. The shower devices 168 and 174 are provided to shower water on the hot gases exiting from the 2200° F. secondary combustion chamber 24. The water cools the gases to approximately 180° F., which is necessary due to the fiberglass construction of the remaining components of the scrubber section 37.

After passing through the quench tube 30, the waste gases enter the venturi 34. The venturi 34 is a venturi tube of standard design which is well known in the art. The venturi 34 accelerates the waste gases and any particulates burned out of the gases by the secondary combustion chamber 24. As the particulates and the waste gases are accelerated, they pass through a water mist from a spray device 177. The spray device 177 is provided with water by a line 178 from the pump 172.

Due to the nature of the accelerated waste gases and the particulates, the gases will pass unaffected through the water mist but the particulates will be absorbed by the water. The waste gases and the water absorbed particulates then enter the absorber portion 36 of the scrubber section 37. The absorber portion 36 is comprised of a demister section 180 and an absorber section 182.

The waste gases and the water absorbed particulates first pass through the demister section 180. The demister section 180 provides multiple series of maze-like channels (not shown) with sharp turns which the waste gases and the absorbed particulates must negotiate. Many of the absorbed particulates are unable to negotiate the sharp turns and are thus deposited on the walls of the demister section 180. These water absorbed particulates are then drained downward by the force of gravity into a sump 184 in the bottom of the demister section 180. The water absorbed particulates are then pulled out of the sump 184 by the water pump 172.

The remaining waste gases will next enter the absorber section 182. The absorber section 182 passes appropriate chemicals over the waste gases by a device (not shown). The chemicals convert the acid gases contained in the waste gases into solids of sufficient size to be deposited in a sump 186. The now clean exhaust exits the absorber section 182 through the induced draft fan 38 (not shown).

The chemicals and the solids pass over a separation wall 188 into the sump 184. The chemicals, the solids and the absorbed particulates are all pulled through a drain 190 and a water line 192 by the pump 172. A portion of this "dirty" drainage is discharged by the pump 172 through a line 194. The remaining drainage is recycled through the quench tube 30 along with fresh water from the water supply (not shown).

The scrubber section 37 is carried by a standard I-beam flatbed trailer 196. Integral with the trailer 196 is a gooseneck 198. Two sets of dual wheels 200 are fixedly attached to the trailer 196. The trailer 196 has three sets of hydraulic jacks 202, 204 and 206 which are attached and operated identically to those of the primary combustion chamber 20.

The quench tube 30 and the venturi 34 are supported by support structures 208 and 210, respectively. The support structures 208 and 210 may be constructed of any suitable material, such as steel, that can support the quench tube 30 and the venturi 34 during travel.

The induced draft fan 38 is attached by sealing means (not shown) to the absorber section 182 of the scrubber section 37, FIG. 10. The induced draft fan 38 sends the clean exhaust out the exhaust stack 40. A backup induced draft fan 44 is connected to the induced draft fan 38 so that it may be immediately operated to replace the induced draft fan 38 if it should fail.

The induced draft fan 38, the exhaust stack 40 and the backup induced draft fan 44 comprise the emergency backup trailer 42. The emergency backup trailer 42 is a standard flatbed design having a skid 208, an integral gooseneck 210 and two sets of dual wheels 212. Hingedly attached to the skid 208 are three sets of hydraulic jacks 214, 216 and 218. Although not shown, the jacks 214, 216 and 218 have the identical operation and control as do the hydraulic jacks 86, 88 and 90 of the primary combustion chamber 20.

In normal installations, a concrete slab is poured at the remote waste site. The concrete slab is surveyed and marked for proper emplacement of the mobile hazardous waste treatment system.

Upon arriving at the remote site, the primary combustion chamber 20 is driven onto the concrete slab and positioned over its surveyed location. A device, such as, for example, a plumb bob, is used to insure that the primary combustion chamber 20 is properly positioned as surveyed.

The trailer and support section 74 of the primary combustion chamber 20 is removed from its towing vehicle by methods well known in the art. The three sets of hydraulic jacks 86, 88 and 90 are swung down on their hinges 110 and fixed in their operating position (FIG. 4). The sets of jacks 86, 88 and 90 are adjusted by an operator from the control panel 85 (FIG. 2) so that the trailer and support section 74 is level on the concrete slab. Jack stands (not shown) are placed under the trailer and support section 74 and shimmed, if necessary. The hydraulic jacks 86, 88 and 90 are then lowered and returned to their storage position (FIG. 4) leaving the trailer and support section 74 to rest on the jack stands. The primary combustion chamber bolts 98 are loosened at this time so that expansion of the primary combustion chamber 20 may be compensated for by the slots 102.

The secondary combustion chamber 24 is emplaced by backing the first section 23 up to the second section 25. Plumb bobs are used to insure that both trailer sections are in their proper surveyed position.

The first and second sections 23 and 25 are leveled and placed on jack stands in the same manner as the primary combustion chamber 20. Once leveled, the first and second sections 23 and 25 are sealingly attached to each other by bolting the matching flanges 126 and 128 together (FIG. 6). RTV and silicon grease are applied between the flanges 126 and 128 to form an airtight seal.

The crossover duct 22 is positioned over the primary combustion chamber 20 and the secondary combustion chamber 24. The crossover duct 22 is attached to the secondary combustion chamber 24 by bolting the flanges 141–142, and 143–144 (FIG. 8) together and applying RTV and silicone grease to the gaps between them as is described above. Following the same procedure the crossover shaft 22 is attached to the primary combustion chamber 20.

The scrubber section 37 is backed up to the second section 25 of the secondary combustion chamber 24 and positioned by the use of plumb bobs. The quench tubes 28 and 30 are connected to the transition duct 26 and sealed by any appropriate method.

The emergency backup trailer 39 is then positioned behind the scrubber section 37 and also plumb bobbed into position. The emergency backup trailer 39 is leveled using the same procedure as used for the primary combustion chamber 20. The induced draft fan 38 is attached to the absorber portion 36 and the exhaust stack 40 is raised into position.

The power van 12 and the control van 14 are placed at convenient locations and connected to the mobile hazardous waste system 10 as required. The hopper 16 and the conveyor 18 are placed into position near the primary combustion chamber 20. The mobile waste system 10 is powered and waste is processed.

The disassembly process is the reverse of the above listed assembly process. It is a technical advantage of the present invention that the entire mobile hazardous waste system 10 can be completely assembled or disassembled rapidly. It is a further technical advantage that the present invention is completely mobile.

Although the present invention has been described with respect to a specific preferred embodiment thereof, various changes and modifications may be suggested to one skilled in the art and it is intended that the present invention encompass such changes and modifications as fall within the scope of the appended claims.

What is claimed:

1. A mobile waste treatment system, comprising:

a primary combustion chamber for receiving and burning waste material, said primary combustion chamber independently mounting on a first road transportable unit;

a secondary combustion chamber for further burning said waste material, said second combustion chamber inter-connectable with said primary combustion chamber, said second combustion chamber independently mounted on a second road transportable unit; and a scrubber section for finally processing said waste material, said scrubber section interconnectable with said secondary combustion chamber, said scrubber section independently mounted on a third road transportable unit;

said first, second, and third road transportable units each comprising a trailer having a skid section:

wherein said first road transportable unit trailer further comprises a support structure for supporting said primary combustion chamber on said skid section, said support structure fixably attached to said skid section and adjustably attached to said primary combustion chamber.

2. The mobile waste treatment system of claim 1, wherein each of said first, second and third road transportable unit trailers further comprise:

a gooseneck integral with said skid section; and a wheel section permanently attached to said skid section distal said gooseneck.

3. The mobile waste treatment system of claim 2, wherein said permanently attached wheel section of said trailer for said primary combustion chamber comprises four sets of dual wheels, with one of said sets slidably adjustable on said skid section.

4. The mobile waste treatment system of claim 1, wherein said secondary combustion chamber further comprises a pair of interconnecting secondary combustion chamber sections.

5. The mobile waste treatment system of claim 4, wherein one of said road transportable units further includes a separate trailer for each of said interconnecting secondary combustion chamber sections, each comprising:

a skid section;

a gooseneck integral with said skid section; and a wheel section permanently attached to said skid section distal said gooseneck.

6. The mobile waste treatment system of claim 4, wherein said pair of interconnecting secondary combustion chamber sections are interconnected by flanges attached to the end of each of said sections.

7. The mobile waste treatment system of claim 6, wherein said flanges are bolted and sealed together.

8. The mobile waste treatment system of claim 2, wherein said skid section has three sets of hydraulic jacks mounted by hinges, wherein said jacks may be swung upward on said hinges for travelling and may be swung downward on said hinges for emplacement of said trailer means.

9. The mobile waste treatment system of claim 8, wherein said three sets of hydraulic jacks are adjusted by a control station on said skid.

10. The mobile waste treatment system of claim 1, wherein said secondary combustion chamber is interconnectable to said primary combustion chamber by a crossover such.

11. The moble waste treatment system of claim 10, wherein said crossover duct is connected to said primary and secondary chambers by flanges.

12. The mobile waste treatment system of claim 11, wherein said flanges are bolted and sealed together.

13. The mobile waste treatment system of claim 1, wherein said support structure is adjustably attached to said primary combustion chamber by bolts inserted into matching slots in said support structure and said primary combustion chamber.

14. A mobile hazardous waste treatment system fully transportable to a remote site, comprising:

truck mounted means for controlling the operation of said mobile facility and for carrying the necessary power transformers for the mobile treatment facility;

a primary combustion chamber for converting waste material into ash and gas, said primary combustion chamber supportably mounted on a first wheeled trailer by mounting means;

said mounting means fixedly attached to said first wheeled trailer;

said primary combustion chamber adjustably attached to said mounting means;

means for feeding said primary combustion chamber with the waste material;

a secondary combustion chamber mounted on a second wheeled trailer;

means for interconnecting said primary combustion chamber to said secondary combustion chamber in order to transfer said gas from said primary combustion chamber to said secondary combustion chamber;

said secondary combustion chamber having means for further burning and cleaning said gas from said primary combustion chamber;

a scrubber section mounted on a third wheeled trailer for receiving and finally cleaning the gas from said secondary combustion chamber;

fan means for providing an air draft from said primary combustion chamber to said secondary combustion chamber and from said secondary combustion chamber to said scrubber section;

an exhaust stack attached to said induced draft fan for exhausting said finally cleaned gas to the atmosphere;

said fan means and said exhaust stack mounted to a fourth wheeled trailer; and each of said wheel trailers being connectable to towing means for transportation to the remote treatment site.

* * * * *